US006086448A

United States Patent [19]

Ibañez

[11] Patent Number: 6,086,448

[45] Date of Patent: Jul. 11, 2000

[54] TOY DEVICE FOR COMBINED PRODUCTION OF MOVEMENTS AND SONOROUS EFFECTS

[76] Inventor: Carlos Valls Ibañez, Fray Luis de León, 18, 03440-Ibi, Spain

[21] Appl. No.: 09/104,876

[22] Filed: Jun. 25, 1998

[51] Int. Cl.[7] ..... A63H 5/00; G09F 17/00

[52] U.S. Cl. ..... 446/397; 446/489; 446/491; 40/218

[58] Field of Search ..... 446/175, 486, 446/489, 491, 397, 404; 40/218, 427

[56] References Cited

U.S. PATENT DOCUMENTS

| | | | |
|---|---|---|---|
| 3,742,490 | 6/1973 | Henderson . | |
| 3,792,680 | 2/1974 | Allen . | |
| 3,923,001 | 12/1975 | Murdock . | |
| 3,952,695 | 4/1976 | Vollstedt . | |
| 3,976,283 | 8/1976 | Schmit . | |
| 3,997,993 | 12/1976 | Flaherty | 40/218 |
| 4,791,878 | 12/1988 | Lewis | 116/173 |
| 5,364,074 | 11/1994 | Gourley | 254/375 |
| 5,692,328 | 12/1997 | Pettit | 40/218 |

*Primary Examiner*—Robert A. Hafer
*Assistant Examiner*—Jeffrey D. Carlson
*Attorney, Agent, or Firm*—Adams Law Firm, P.A.

[57] ABSTRACT

Joy device of a casing in a form of pedestal, upon a mast for hauling up a flag by means of a strand pulled by a mechanic device is fixed, all in time to a sonorous emission generated by a sound electronic chip included into the casing. According to the invention, the mast is detachable and is provided a housing for bearing a portion of the mast at the detached state. Furthermore advantages arise when the sound chip is mounted upon the outside of the housing of the feed bateries of the sound chip and when the switch for the electric feed is provided in a form of resiently deformable membrane operatively faced to the bottom end of an operation push-button provided on the casing.

4 Claims, 4 Drawing Sheets

TOY DEVICE FOR COMBINED PRODUCTION OF MOVEMENTS AND SONOROUS EFFECTS

SPECIFICATION

An improved toy device for combined production of movements and sonorous effects.

BACKGROUND OF THE INVENTION

The invention refers to a device for the production of combined effects of movement and sound for toys, more particularly to a device of toy with a pedestal and a mast with an element, for instance a flag, disposed upon a sliding bearing along the said mast in such a way that the said flag may be hauled down or raised by means of a string of yarn through a spring mechanism included on the pedestal while a determinated sonorous emission generated by an electro-sonorous device, which is activated by means of the action of a switch operatively faced to the sliding bearing of the mast is reproduced.

Devices of this type, which present various disadvantages are known. For instance, of the known devices the total height of the device, substantially determined by the length of the mast, gives rise to the use of containers or boxes for commercialization which holds a relatively important volume, in such a way that important expenses of transportation and storage are originated.

On the other hand, these known toys use phonographic devices for playing acoustic disks. Such devices are voluminous, are not very reliable, have a limited life, and are expensive because of the acoustic disks which are used in them.

SUMMARY OF THE INVENTION

It is an object of the invention to develop a toy device of the type initially pointed out which shall be partially removable so as to decrease its packaging volume and, furthermore, of liable mechanical operativity and low cost and in which, moreover, the means of sound generation enables a relatively high sound quality with a reduced cost.

According to the invention this job is reached starting from a device which comprises:

a casing with the shape of a pedestal internally hollow, in the inside part of which an electronic sound chip is provided with amplifier means and a speaker which is fixed upon a box for some feeding electric batteries of the said chip, as well as a spring mechanism for unfolding and retraction of a string of yarn passing through a hole of the said casing;

a mast, the bottom end of which is fixed upon the said pedestal and upon which is disposed slidingly a bearing having a bushing shape with a bottom portion with the shape of perimeter flange which bears a flag or similar fixed on it and which is attached on its bottom part to the final end of the said string of yarn;

a guide element with pulley shape disposed on the top end of the mast so as to lead along the said mast the string of yarn of the said spring mechanical device between the bottom part of the pedestal and the perimeter flange of the sliding bearing; and a pushbutton mounted movable upon the said pedestal with a top end operatively faced to the perimetral flange of the sliding bearing and a bottom end which extends along the inside of the casing which in its turn is operatively faced to a switch of the sound chip, characterized in that:

i. The mast is provided as a removable piece in at least two portions approximately alike which may be mounted/removed by means of pluging or groove and tongue engagement;

ii. On the top part of the pedestal is provided a housing with the shape of a tube for tight engagement of one of the portions of the mast in a removed state; and iii. The switch of the electronic sound chip is in positive joining with a membrane resiliently yieldable operatively faced to the bottom end of the said pushbutton.

According to an additional feature of the invention, the removable portions of the mast have respectively pluging ends with the shape of polygonal section rod and of corresponding polygonal interior section tube, for instance a square.

Additionally, according to the invention it is advantageous that the sound electonic chip is fixed upon the exterior side of the housing of the feeding batteries.

It is yet an advantage for the invention, when on the wire guide pulley is provided a piece with U-shape which extends facing to the throat of the said pulley and which serves to prevent the string of yarn from coming out and which has some ends leant with the shape of a gaff which are fitted into grooves of the bearing of the said pulley.

BRIEF DESCRIPTION OF THE DRAWING

Other features and advantages of the invention will be evident more clearly from the following description performed with the help of the enclosed drawings related to an example of non limiting embodiment and in which.

DETAILED DESCRIPTION OF THE INVENTION

Figure 1A:
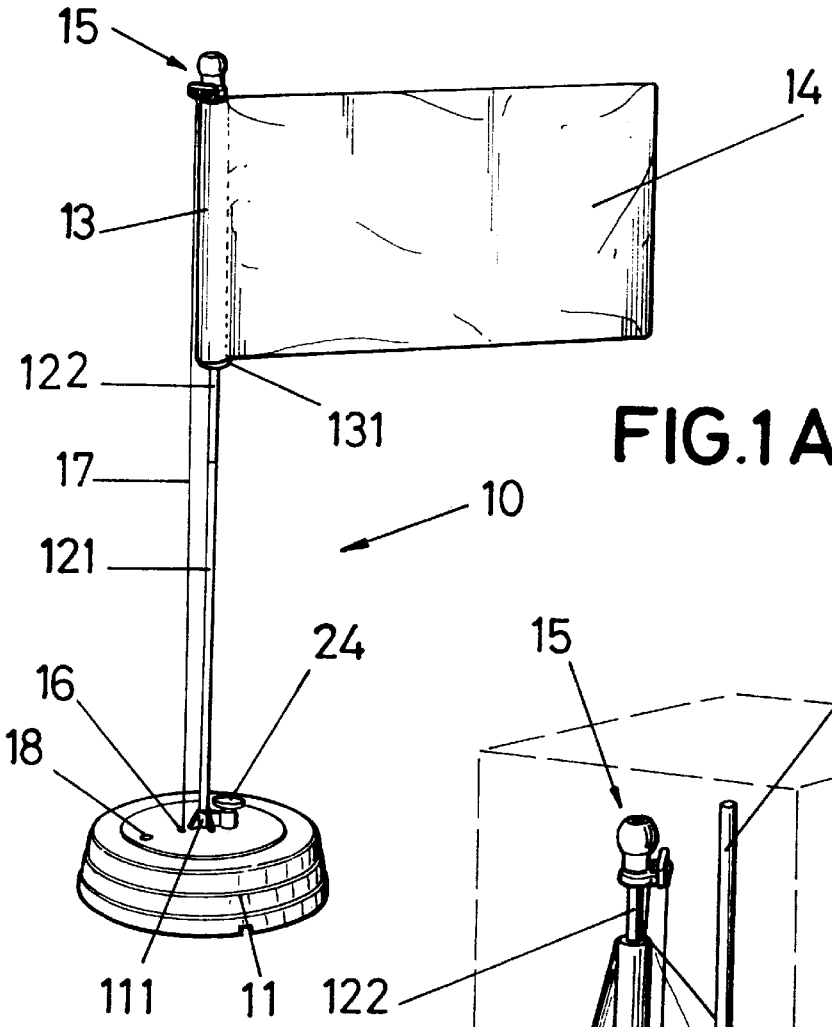
FIG. 1A represents a perspective view of the device according to the invention which is found to be mounted for its ludic use.

With reference to FIS. 1A–1B there is represented a toy device designed generally with the reference 10.

This device 10 consists of an abutment pedestal 11, a mast 12 fixed to the pedestal 11 upon a bearing 111, a movable bearing 13 with the shape of a coaxial bushing and mounted so as to slide upon the mast 12 and to which is fixed, for instance, a flag 14.

Additionally, between the bottom part 131 with the shape of a flange of the movable bearing 13, a guiding device 15 and a bore 16 provided on the top surface of the pedestal 11 is laying a string of yarn 17.

This way, with the unfolding/retraction of the string of yarn 17, by means of spring mechanisms 25 as it will be further explained in detail, the movable bearing 13 may slide along the mast 12, so as to produce, in such a way, the haul down/raising of the flag 14.

Figure 1B:
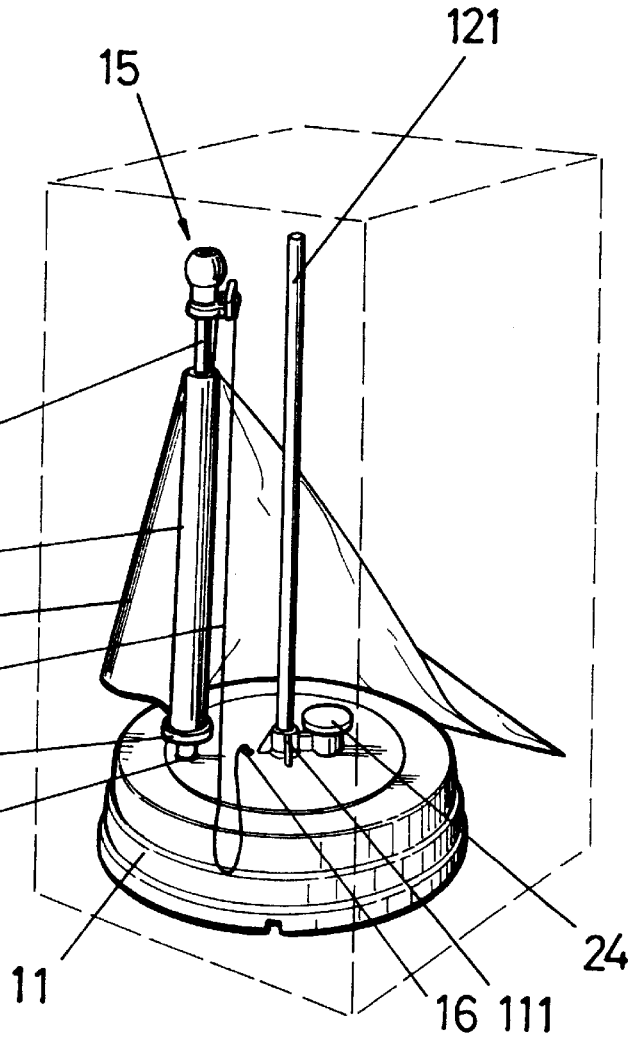
FIG. 1B of the device according to FIG. 1, also represents a perspective view but removed for its transportation and storage on a packaging with the shape of a box.

According to the invention as it will be further explained in detail, the mast 12, is provided removably in at least two parts 121 and 122 approximately alike and which can be plugged with each other. In this way, as it is shown in a specially clear way by the FIG. 1B the mast portion 122 when it is removed from the mast portion 121 may be placed on a housing 18 with the shape of a tube provided on the pedestal 11.

Figure 2:
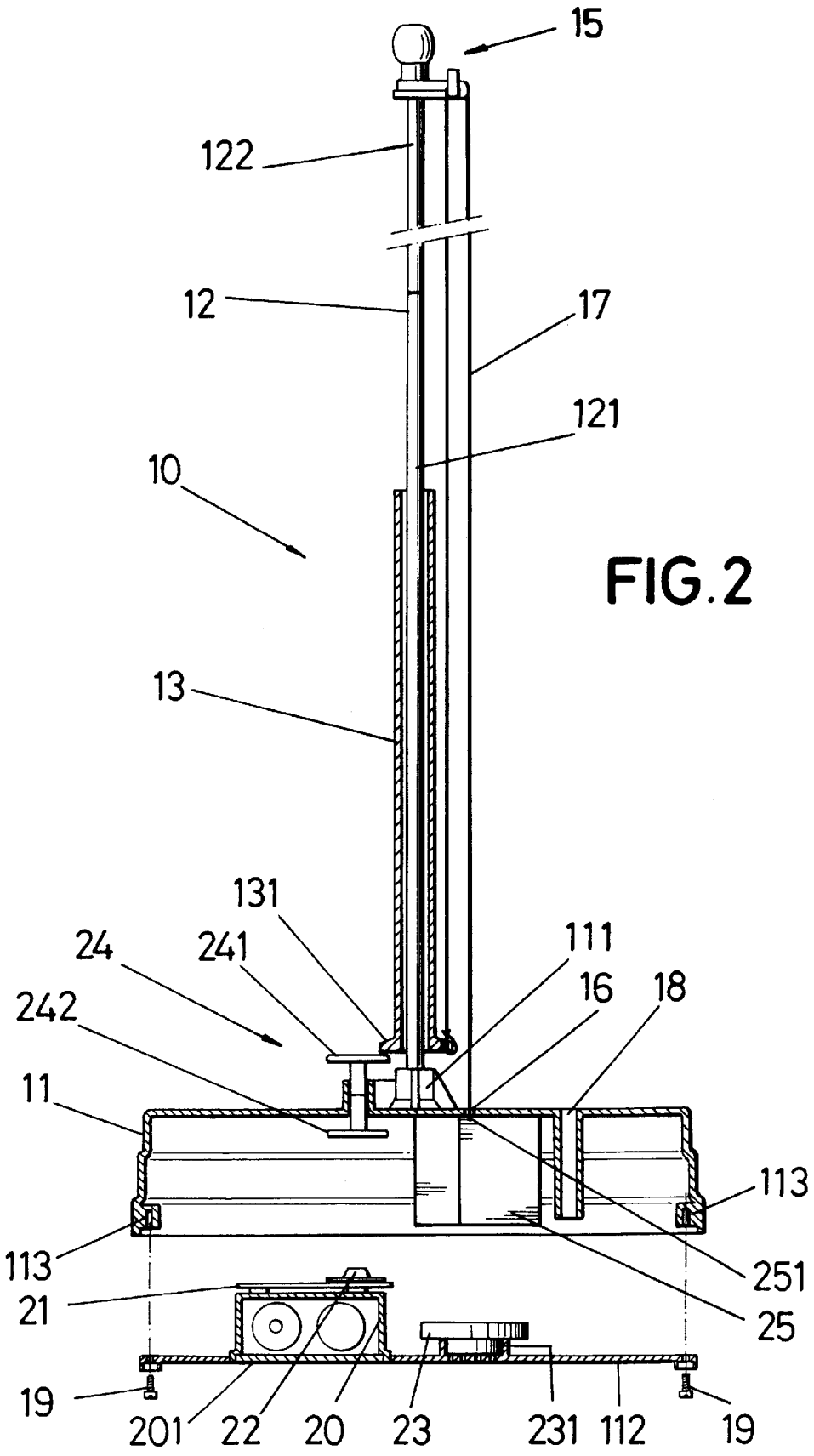
FIG. 2 shows an elevation view of the device according to FIGS. 1A–1B, partially in cross-section.

A removable arrangement of this type enables reducing substantially the volume of packaging of the device 10 which, as it is shown schematically with a dash line in FIG. 2, may be housed on a box of relatively reduced dimensions, in such a way that transportation and storage expenses may be saved.

Now, additionally in reference to FIG. 2, it may be seen that the pedestal 11, hollow in its interior, has a bottom cap 112 which may be fixed by means of screws 19 which can be coupled on housings 113 provided on the bottom edges of the side wall of the pedestal 11. Upon this cap 112 and inside the pedestal 11, a box 20 for electric batteries with a cap 201 which can be opened from the outside is fixedly disposed, being mounted on the box top part 20 a card or electronic board plate 21 which incorporates a sound chip and a switch in positive joining with a yieldably resilient membrane 22 and a speaker 23 fitted into a housing 231 provided with this end upon the cap 112.

On the other hand, on the pedestal 11 is provided a movable pushbutton 24 which has a top end 241 operatively faced to the flange 131 of the movable bearing 13, as well as a bottom end 242, for example with the shape of a knob, which extends inside the pedestal 11 and which is operatively faced to the resilient membrane 22 of the switch of the circuit 21. In such a way, when the movable bearing 13 occupies a lowered position, activated by the user, as it is represented by FIG. 2, its flange 131 will impinge upon the top end 241 of the button 24 so that, furthermore, the bottom end 242 will impinge upon the swith 22 of resilient membrane causing the corresponding connection of the electronic circuit 21 and so the corresponding sound emission.

As it can also be observed from FIG. 2, on the top part of the inside of the pedestal 11, a spring mechanism 25, which serves as it will be further explained to unfolding/retract the said string of yarn 17, is fixedly mounted. This mechanism 25 has an output hole 251 for the string of yarn 17 which lays on the proximity of the bore 16 of the pedestal in such a way that the said string of yarn 17 may go along the said bore 16 in a way essentially straight. In this way, as it has been above explained, the flag 14 may be raised upon the mast 12 thanks to the winding of the string of yarn 17 by means of the said spring mechanism 25.

Figure 3A:
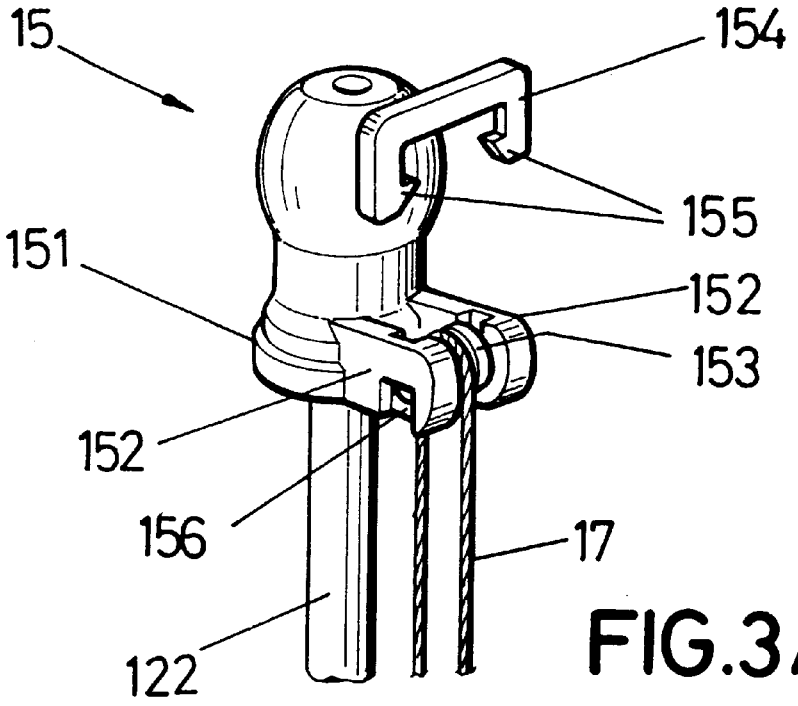
FIG. 3A is a perspective view which shows a detail of the top part of the device of FIGS. 1A–1B.
Figure 3B:
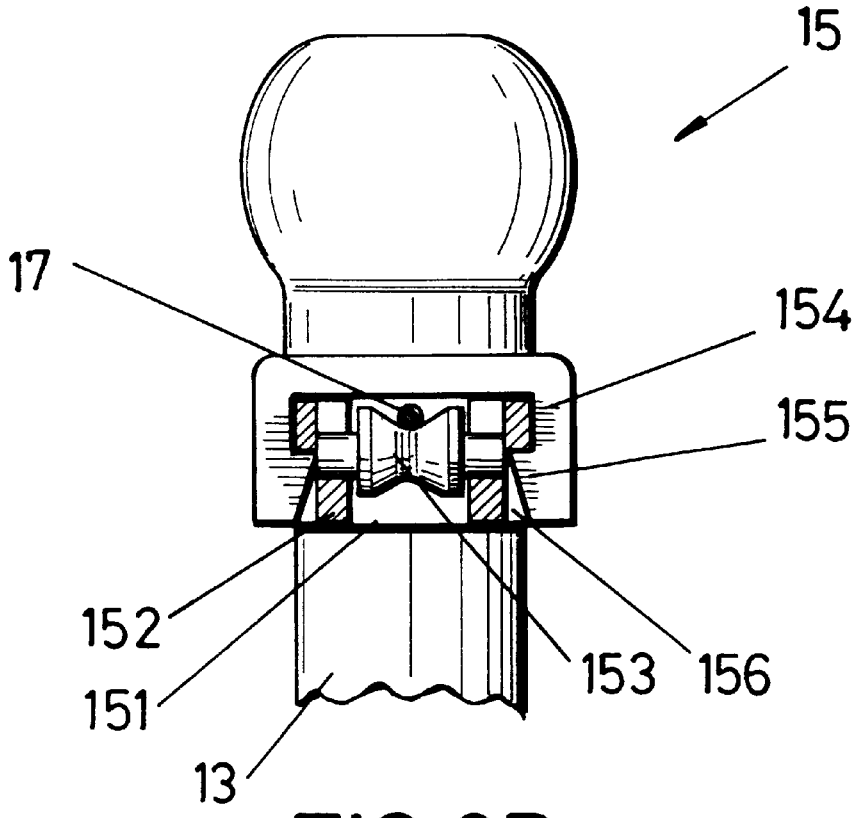
FIG. 3B is a top plan view of the detail according to FIG. 3A.

With additional reference to the FIGS. 3A and 3B it can be seen that on the top part of the mast 12, a guiding device is mounted designed in general with the reference numeral 15 which has a bearing 151 which can be fitted on the mast 12 which consists of horizontal arms 152 which bear a pulley 153 by which throat the string of yarn 17 is guided. Additionally, and so as to prevent the string of yarn from misplacing, is provided a piece 154 with U-shape which has ends 155 with the shape of a gaff attachable into grooves 156 correspondingly provided on the said bearing horizontal arms 152.

Figure 4:
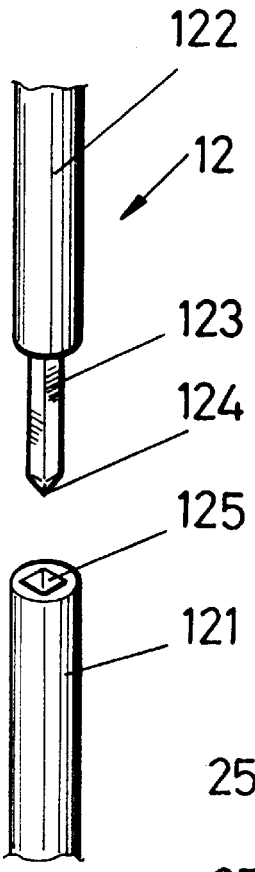
FIG. 4 is a perspective view which shows the pluging engagement of the mast of the device according to FIGS. 1A–1B.

With reference to the FIG. 4, the fittable portions 121 and 122 of the mast 12 present respectively a polygonal cross sectional rod 123, for instance, squared, ended on a peak 124 and a correspondingly polygonal hole 125, for instance, squared, in such a way that a fitted attachment of the said parts 121 and 122, enough liable as well as easily removed for its packaging can be reached.

Figure 5A:
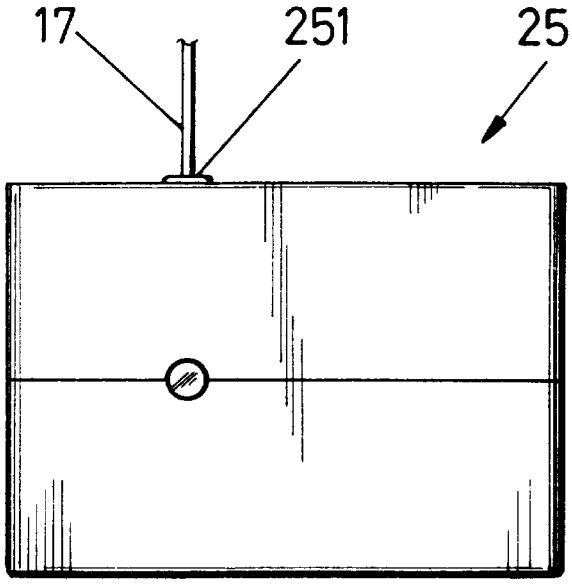
FIG. 5A is an elevation view of a spring mechanism for unfolding/retraction of the string of yarn of the device according to FIGS. 1A–1B.
Figure 5B:
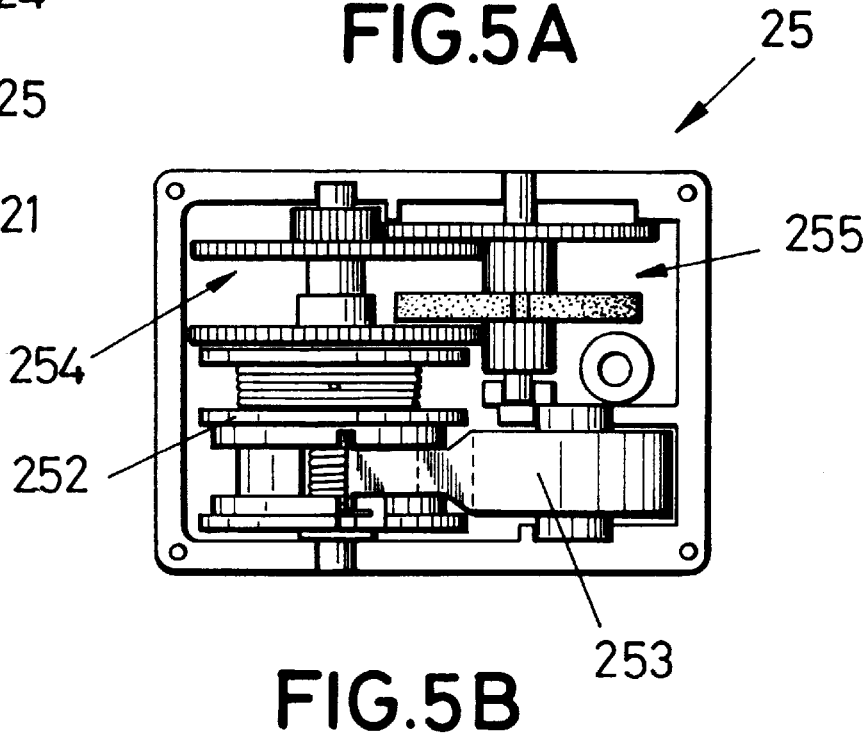
FIG. 5B is a removed top plan view of the spring mechanism for unfolding/retraction of the string of yarn according to FIG. 5A.

Finally, as it can be presented by FIGS. 5A and 5B the mechanism 25 for unfolding and retraction of the string of yarn 17 has on its interior a reel 252 stretched against the recovery force of a helical strip spring 253 upon which can be winded/unwinded the said string of yarn 17; additionally, the said mechanism includes gear trains designed generally as 254 and 255 which enable the operation of the mechanism. This spring mechanism 25 is available on the market, this is the reason why its description has been performed in a superficial way, including it hereby only as a reference.

As it will be easily understood by a person skilled in the art, the circuit plate 21 which incorporates a sound chip, for instance, with the national anthem of a country, and the corresponding speaker, is not a part of the invention for being known by itself, and it will be available on the most adequate form from the technical point of view. It should be also mentioned at this point that any representation and description of the feeding electric bateries connections and the connection of the above mentioned electric and electronic devices has been omitted.

Once the invention has been described, it only lasts to point out that the embodiments derived from an ordinary application of the above revealed, must be considered included on its field, in a way that the invention is only limited by the scope of the following claims.

I claim:

1. An improved toy device for combined production of movements and sonorous effects, which comprises:

a casing (11) with the shape of a pedestal internally hollow, and including in the inside part an electronic sound chip (21) and electric batteries, the chip (21) is provided with amplifier means and a speaker (23) which is fixed upon a box (20), as well as a string of yarn 17 and a spring mechanism (25) for unfolding and retraction of the string of yarn (17), said string of yarn (17) passing through a hole (16) of said casing (11);

a mast (12) the bottom end of which is fixed upon the said pedestal (11) and upon which is disposed slidingly a bearing (13) having a bushing shape with a bottom portion (131) with the shape of a perimeter flange which bears a flag (14) fixed on it and which is attached on its bottom part (131) to the final end of the said string of yarn (17);

a guide element (15) with a pulley (153) disposed on the top end of the mast (12) so as to lead along the said mast the string of yarn (17) arising from the said spring mechanism (25) between the hole (16) and the perimetral flange (131) of the sliding bearing; and a pushbutton (24) mounted movably upon the said pedestal (11) with a top end (241) operatively faced to the perimetral flange (131) of the sliding bearing (13) and a bottom end (242) which extends along the inside of the casing (11) which in turn is operatively faced to a switch of the sound chip, wherein:

i. The mast (12) is provided as a removable piece in at least two portions (121 and 122) approximately alike which are removably connected to each other by means of complementary male and female parts;

ii. On the top part of the pedestal (11) is provided a housing with the shape of a tube (18) for tight engagement of one of the portions (122) of the mast in a removed state; and iii. The switch of the sound electronic chip (21) is in positive joining with a membrane (22) resiliently yieldable operatively faced to the bottom end (242) of the said movable pushbutton (24).

2. A toy device according to claim 1, wherein the complementary male and female parts of the removable portions (121, 122) of the mast (12) are formed, respectively, in the shape of a rod (123) of polygonal section with a peak (124) and of correspondingly polygonal interior section tube (125) having a square cross section.

3. A toy device according to claim 1, wherein the sound electronic chip (21) is fixed upon the top part of the box (20) of its electric feeding batteries.

4. A device according to claim 1, wherein in the guide element (15) of the string of yarn (17) is provided a piece (154) with a U-shape which extends downwardly to the pulley's throat (153) and which serves to enable the output of the string of yarn (17) and which has inwardly-turned ends (155) which are adapted to fit fitted into grooves (156) of the bearing arms (152) of said pulley (153).

* * * * *

UNITED STATES PATENT AND TRADEMARK OFFICE

CERTIFICATE OF CORRECTION

PATENT NO : 6,086,448

DATED : July 11, 2000

INVENTOR(S): Valls Ibañez, Carlos

It is certified that error appears in the above-identified patent and that said Letters Patent are hereby corrected as shown below:

The cover of the patent should identify the inventor's surname as:

Valls Ibañez

Signed and Sealed this

Tenth Day of April, 2001

*Attest:*

Nicholas P. Godici

NICHOLAS P. GODICI

*Attesting Officer*

*Acting Director of the United States Patent and Trademark Office*